US006012376A

United States Patent [19]

Hanke et al.

[11] Patent Number: 6,012,376

[45] Date of Patent: Jan. 11, 2000

[54] GUN SIGHT SYSTEM FOR A MILITARY VEHICLE

[75] Inventors: Dietmar H. Hanke, Mission Viejo; David A. Hull, Manhattan Beach; Richard R. Smith, Los Angeles, all of Calif.

[73] Assignee: Raytheon Company, Lexington, Mass.

[21] Appl. No.: 08/431,251

[22] Filed: Apr. 28, 1995

[51] Int. Cl.[7] ..... F41G 3/08

[52] U.S. Cl. ..... 89/41.19; 89/41.06; 359/683; 359/697; 359/820

[58] Field of Search ..... 89/36.14, 41.06, 89/41.19; 359/683, 696, 697, 698, 820

[56] References Cited

U.S. PATENT DOCUMENTS

| | | | |
|---|---|---|---|
| 4,333,106 | 6/1982 | Lowe | 358/107 |
| 4,626,077 | 12/1986 | Yamamoto | 359/696 |
| 4,934,246 | 6/1990 | Benson et al. | 89/36.14 |
| 4,948,226 | 8/1990 | Ozaki | 359/820 |
| 5,187,317 | 2/1993 | Pellarin et al. | 89/36.14 |
| 5,231,473 | 7/1993 | Kawamura et al. | 359/696 |
| 5,600,491 | 2/1997 | Hull et al. | 359/698 |

*Primary Examiner*—Stephen M. Johnson
*Attorney, Agent, or Firm*—Colin M. Raufer; Leonard A. Alkov; Glenn H. Lenzen, Jr.

[57] ABSTRACT

An optical gun sight system for an M1A2 Abrams Main Battle Tank supported in a lower housing which may be attached to the fixed internal upper housing in the turret of the tank. An adapter plate is provided which has two sets of openings, one to align with the openings in the upper housing and the other to align with openings in the lower housing. An alignment mechanism allows for fine adjustment of the lower housing relative to the upper housing. Operating buttons, knobs and filter wheel are conveniently located on or beneath the front face of the lower housing. A thermal imaging system includes an objective lens for receiving an image of a target object, an eyepiece lens for viewing the image of the object, and a compensator lens movably located between the objective and eyepiece lenses for providing a thermal image of the object. The system includes a servo motor control system for controlling the position of the compensator lens based upon temperature, range and field of view to provide an accurate thermal image of the object.

13 Claims, 6 Drawing Sheets

FIG. 4
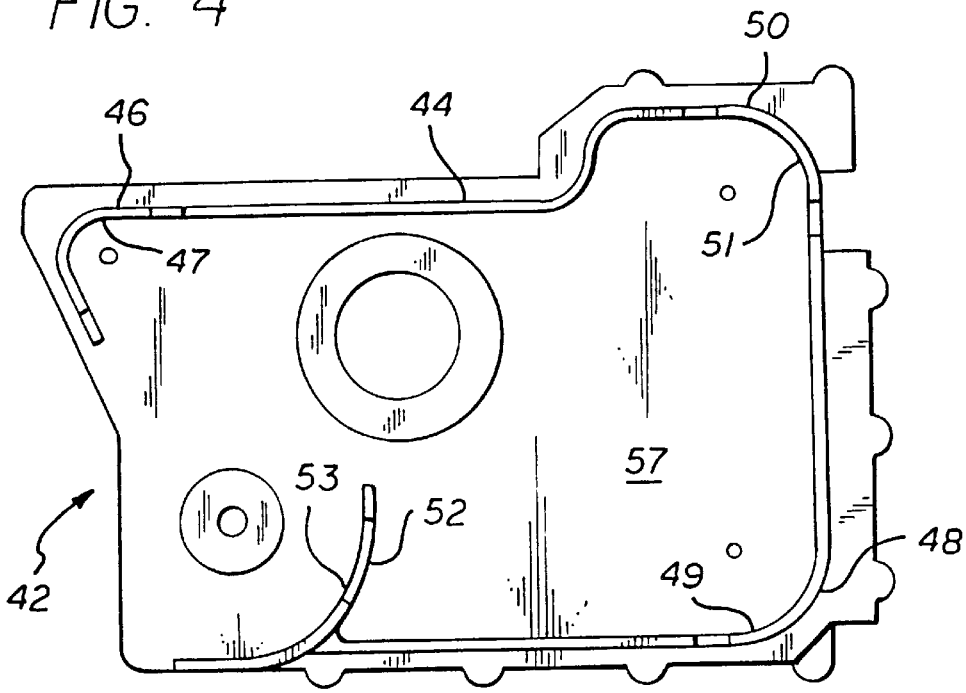
FIG. 5
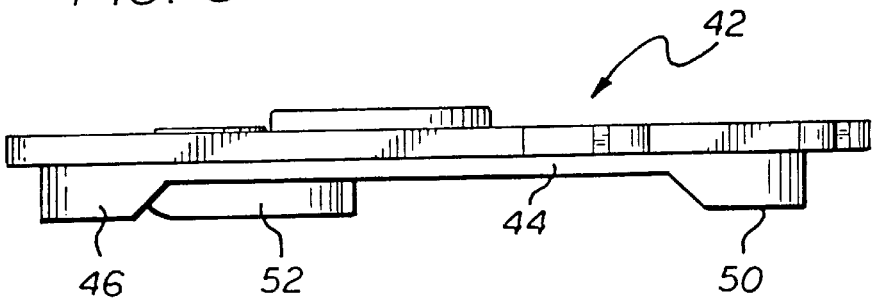
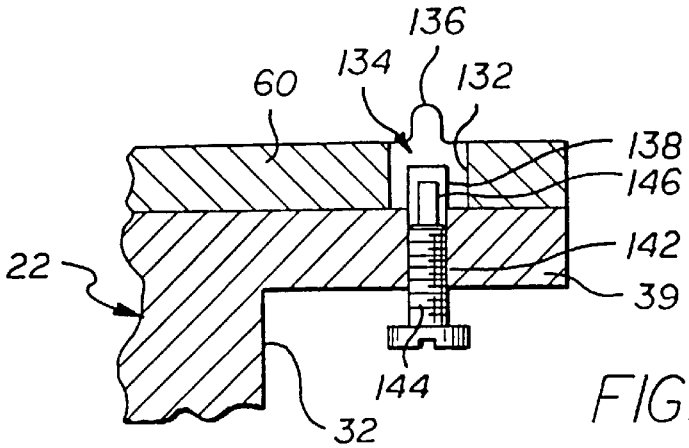
FIG. 9

GUN SIGHT SYSTEM FOR A MILITARY VEHICLE

BACKGROUND OF THE INVENTION

1. Field of the Invention

The present invention relates to a housing for a gun sight system, and more particularly to a housing for mounting an improved thermal imaging system which is especially designed to fit within the U.S. Army's M1A2 Main Battle Tank and other combat vehicles with little or no alteration.

2. Description of the Related Art

The M1A2 Abrams Main Battle Tank uses a thermal imaging gun sight system to control a 120 mm main gun. The conventional sight system operates in two modes through a lens system, one mode to be used in day time and the other mode to be used at night or when the battlefield is obscured. It was found during the fighting in and around Iraq in 1991, popularly referred to as "Desert Storm", that there was a need for increased performance of the gun sight system to allow improved targeting at greater distances. With a range of 3500 yards for the main gun, it can be appreciated that the need for a high performance gun sight system is substantial.

A new three field-of-view thermal imaging gun sight system has been developed by the Hughes Aircraft Company and is the subject of co-pending patent application filed herewith, Entitled "Thermal Imaging System For A Military Vehicle," Ser. No. 08/430,791, (Attorney Docket No. PD-95 124) the teachings of which are incorporated herein by reference. The new system incorporates a high 16× magnification telescope with the existing 3× and 10× telescope used in the current system. The 16× magnification capability represents more than a 30% increase in system performance compared to the existing 10× telescope.

A problem has been encountered in that the new sight system is required to fit within the confines of an existing M1A2 tank. The M1A2 tank includes an exterior viewing port mounted to the tank's turret immediately above the gunner's position inside the turret. Below the external viewing port is an internal housing which extends downwardly into the crew compartment and is fixed in place. A new gun sight system is required to mount within the internal housing and within the dimensional restrictions imposed by the interior of the tank's turret. Prior attempts to meet these constraints had serious shortcomings.

Hence, there is a need in the art for an improved housing to mount the new sight system within the existing confined spaces provided. There is also a need to reduce the chance of damage from handling of the sight system. Problems have been encountered with the existing sight system when it is removed from the tank for maintenance, repair or replacement. The housing to which the system is attached requires a special jig for its support at a work bench or in the field.

There are also problems with the existing housing in relation to the ease by which a gunner is able to operate the controls of the sight system. Again, these problems are caused by the confined spaces within a crew compartment and also by the stress induced by combat.

Also, the sighting system is a very complicated and sophisticated instrument which must be carefully aligned with the tank's turret and thereby the main gun mounted to the turret. There is a need to provide for fine alignment adjustments. In addition, the importance of high optical performance and the cost of tanks and other military vehicles mandate a retrofit of existing vehicles. However, as mentioned, a practical problem facing the manufacturer of a thermal imaging system is that any new system must conform within the aperture and dimensionality constraints or "form factor" of the vehicles. This problem has been addressed by the use of a multiple field of view optical arrangement by which different sets of lens are substituted within the housing depending on the desired range or field of view.

Unfortunately, this requires the user to manually replace one set of lenses with the other and also possibly requires the manual focusing (compensation) thereof.

Accordingly, what is needed is an improved thermal imaging system that affords various powers of magnification and fields of view within conventional form factor constraints which has an automatic focus compensation.

SUMMARY OF THE INVENTION

The need in the art is addressed by the present invention which provides a lower housing for a gun sight having a lens system and associated electronics, the housing comprising four wall portions having a length and height for supporting the lens system and associated electronics in an enclosure, a flange connected to the wall portions adapted to fasten the lower housing to the internal upper housing for fully enclosing the lens system and associated electronics, and an adapter plate having means for connecting to the upper housing and means for connecting to the flange. The invention also includes a method for mounting a gun sight system, including the steps of providing a lower housing, providing an upper housing, providing an adapter plate with two sets of openings, attaching the adapter plate to the upper housing using one of the two sets of openings, and attaching the lower housing to the adapter plate using the other set of openings.

BRIEF DESCRIPTION OF THE DRAWINGS

FIG. 4 is an enlarged bottom plan view of the lower housing of the present invention.

FIG. 5 is an elevational view of the bottom portion of the lower housing of the present invention.

FIG. 9 is an enlarged sectional view of a portion of an alignment mechanism of the present invention taken along line 9—9 of FIG. 6.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

Figure 1:
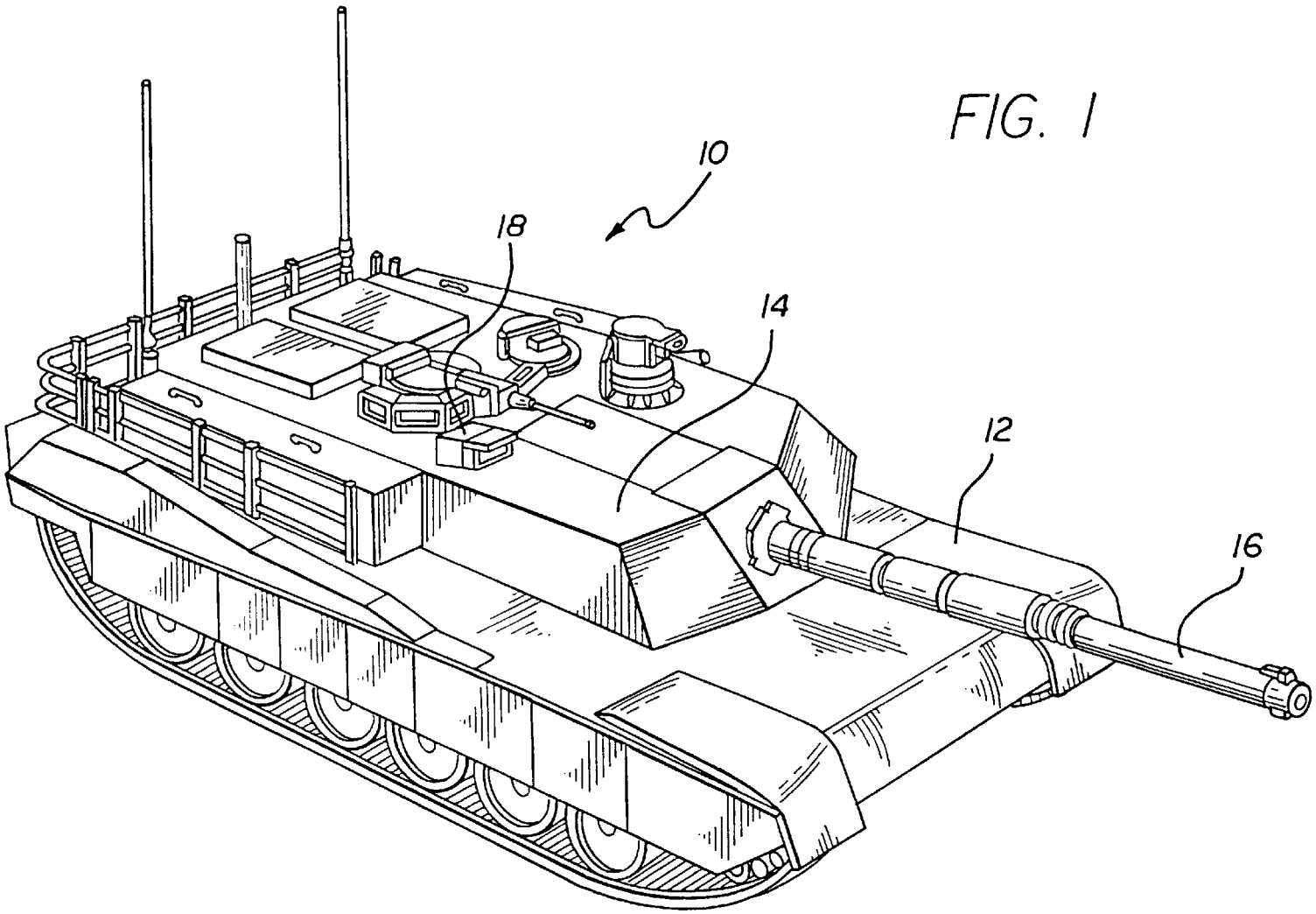
FIG. 1 is an isometric view of an M1A2 Abrams Main Battle Tank illustrating the gunner's external viewing port.

Referring now to FIG. 1 there is illustrated an M1A2 Abrams Main Battle tank 10 comprising a hull 12 to which is mounted a rotatable turret 14. Mounted to the turret is an M256 120 mm main gun 16. Among other things projecting from the top of the turret is an external viewing port 18 through which a gunner seated inside the turret is able to sight the main gun. Mounted beneath the external viewing port is an optical gun sight having a thermal imaging system. The thermal imaging system allows the gunner inside the turret to see targets not only in normal daylight but also at night or through the dust or smoke of battle. The system does this by picking up heat and light emitted by targets, whether they be enemy infantry, tanks, or other vehicles.

Figure 2:
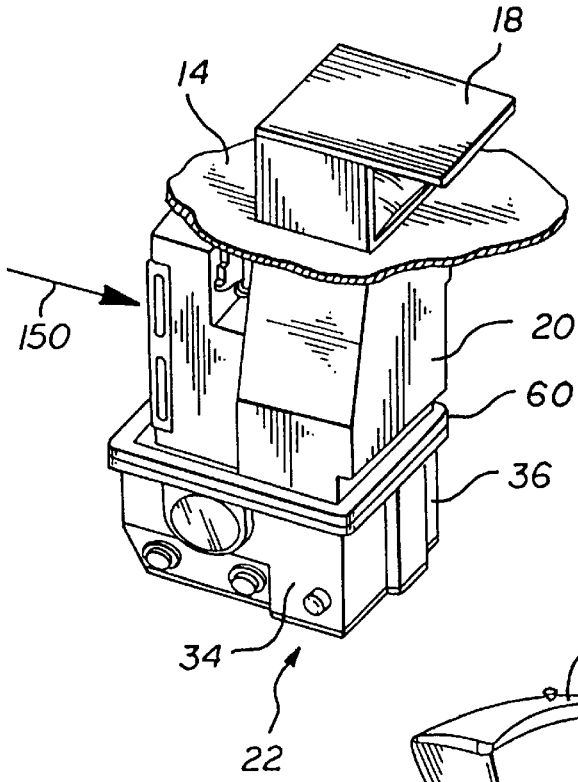
FIG. 2 is an enlarged isometric view of the external viewing port and a breakaway showing the fixed internal upper housing and the lower housing of the present invention.
Figure 3:
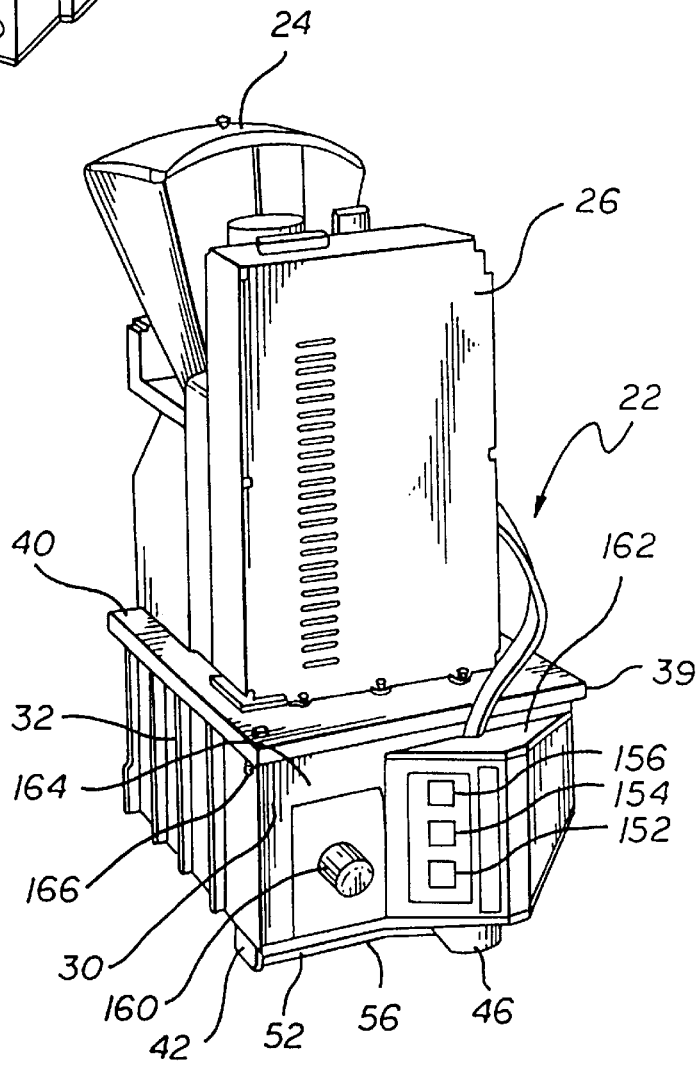
FIG. 3 is an isometric view of the lower housing of the present invention and the lens system and associated electronics from a viewpoint opposite that shown in FIG. 2.

Referring now to FIG. 2 an enlarged view of the external viewing port 18 is shown. Fixed inside the turret is an internal upper housing 20. Fastened to the upper housing is a new lower housing 22 in accordance with the present invention. In FIG. 3, the lower housing 22 is shown detached from the upper housing and turned approximately 180 degrees. Illustrated is the mounting of a three field-of-view lens system 24 and a chassis 26 containing the accessory electronics to operate the lens system.

FIG. 3 also illustrates the advantageous packaging of the lens system and electronics in the lower housing. The lower housing 22 is made of cast aluminum and is extremely rugged. It is constructed of four wall portions, a front wall 30, a left side wall 32, a right side wall 34 (FIG. 2), and a back wall 36 (FIG. 2). The walls have a length and height to enclose the lower portion of the lens system and electronics.

Mounted atop the four wall portions and integral with them is a flange 39 having an upper surface 40 with a plurality of openings, for receiving bolts. The flange 39 extends completely around the lower housing. Connected to the bottom of the four walls, either by bolts or by being cast integrally, is a bottom portion. Preferably the bottom portion is in the form of a plate 42. The four walls and the bottom plate form a box with an opening at the top bordered by the flange 39.

Referring now to FIGS. 4 and 5 the bottom plate 42 is shown in detail. The bottom plate allows the entire lower housing with the mounted lens system and electronics to be self supporting.

As mentioned earlier, a major problem with the existing housing is that it requires a holding jig to be employed when the sight system is removed from the tank. Until this housing is placed on the jig it is difficult to set down in an upright position. Since the sight system is quite heavy, it is very advantageous to have it self supporting to allow it to be deposited on any available surface. As might be expected accidents have occurred in handling the existing system with damage to the sensitive lens. Repairs in the field, where a jig might not be present, is extremely cumbersome, difficult and prone to accidents.

The bottom plate 42 shown in FIGS. 4 and 5 is bolted to the four walls forming an enclosure for the lens system and electronics. Integral with the bottom plate and depending from its lower surface 57 is a rib 44 which extends along about 80% of the periphery of the plate. At three of the corners the rib extends further downwardly to form projections, such as the three foot pads 46, 48 and 50. Each of the three foot pads has an arcuate shape with its concave surfaces 47, 49 and 51 facing toward the center of the plate.

A fourth foot pad 52 is located near the fourth corner of the plate and it too has an arcuate shape. However, the foot pad 52 does not have its concave surface 53 facing the center of the plate, but rather the fourth foot pad 52 is somewhat parallel to the foot pad 48. The four foot pads allow the lower housing to be self supporting on a generally level surface, and in addition, the positioning of the fourth foot pad 52 allows a filter wheel 56, FIG. 3, to be mounted to the lower surface 57 of the bottom plate. In this location it may be operated easily by the gunner who is positioned facing the front wall 30, FIG. 3.

A major advantage achieved with the present invention is its attachment to the existing upper housing within the turret. The upper housing to which the existing housing is attached already has a series of bolt holes (not shown). The present invention allows attachment to the upper housing without an expensive modification; it uses the existing bolt holes.

Figure 6:
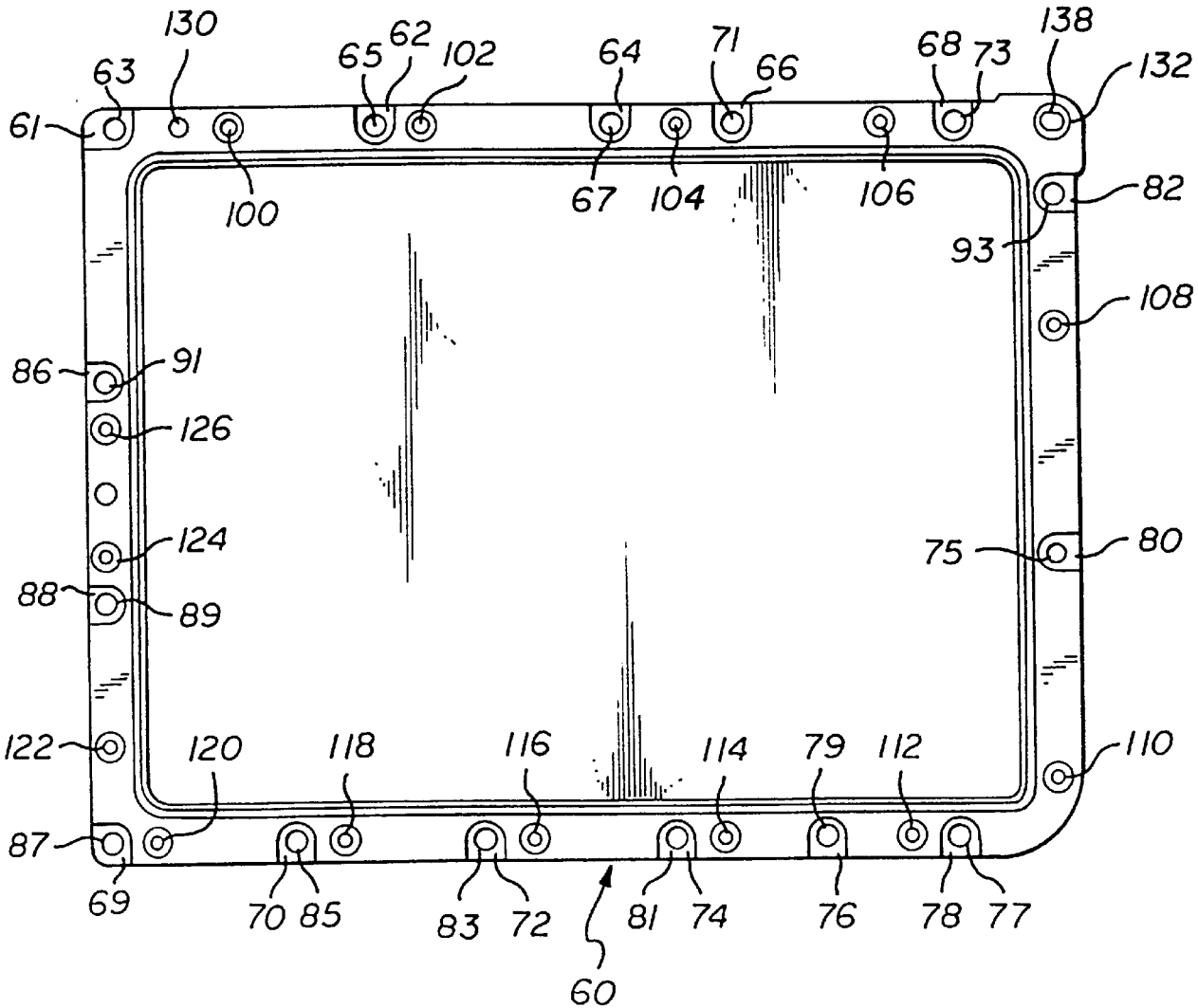
FIG. 6 is a bottom plan view of an adapter plate of the present invention.
Figure 8:
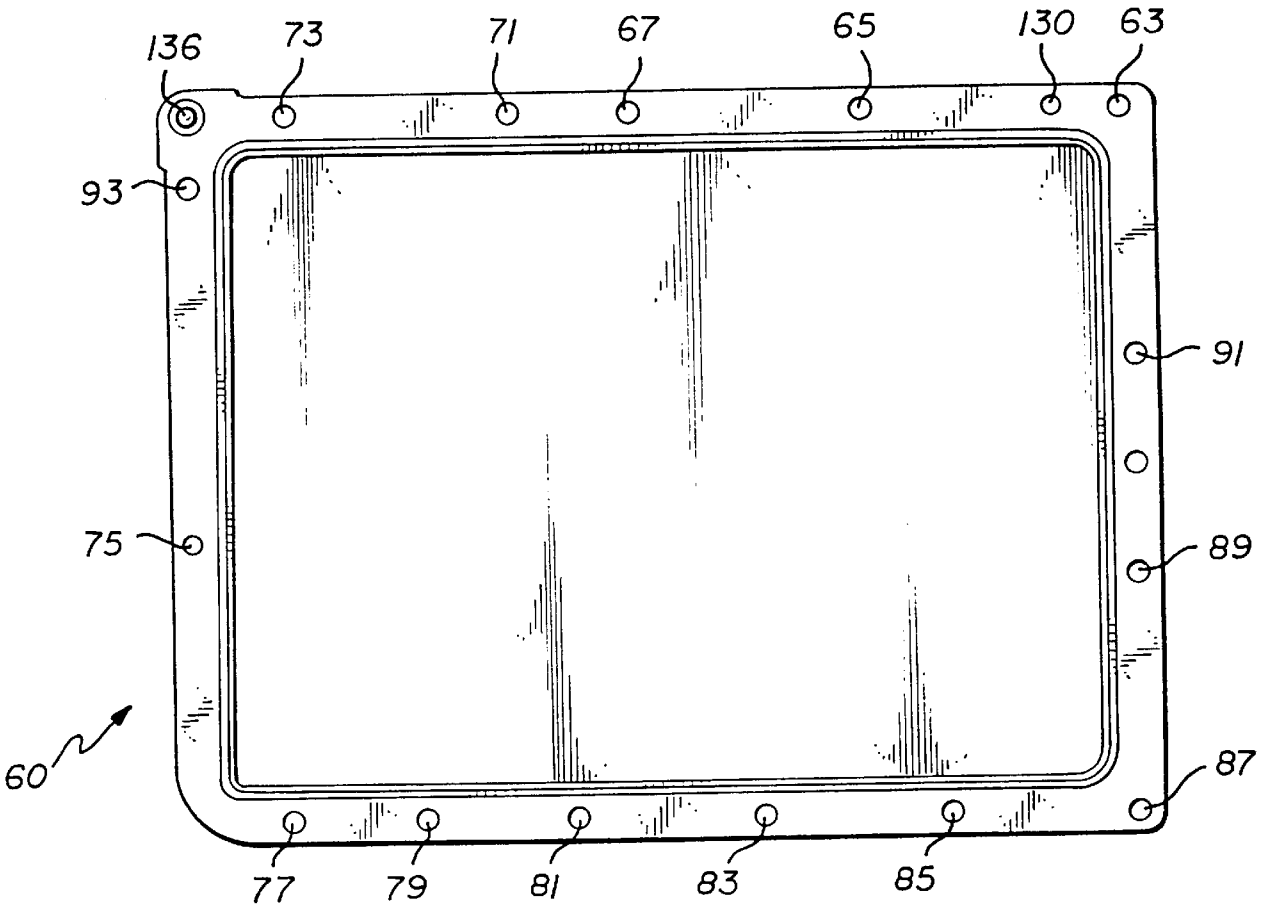
FIG. 8 is a top plan view of the adapter plate of the present invention.
Figure 7:
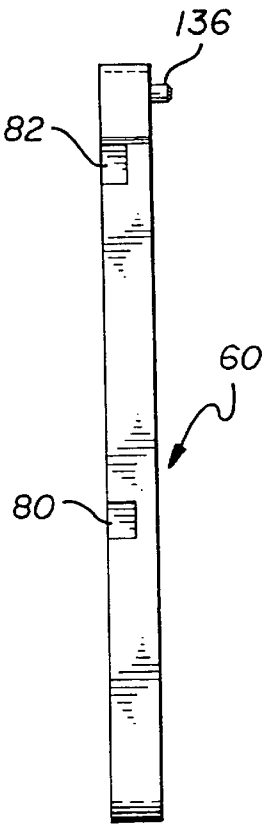
FIG. 7 is an elevational view of the adapter plate of the present invention.

To mount the new lower housing to the upper housing while using existing bolt holes in the upper housing, a specially configured adapter seal plate is provided as shown in FIGS. 6, 7 and 8. The adapter plate 60 is a generally rectangularly shaped frame with a series of peripheral recesses 61, 62, 64, 66 and 68 along one side, recesses 69, 70, 72, 74, 76 and 78 along the opposite side, while an adjacent side includes recesses 80 and 82. The fourth side includes recesses 86 and 88.

As best seen in FIG. 7, the recesses, such as the recess 80, extend about half way through the thickness of the plate. Located within each of the recesses is a first set of openings 63, 65, 67, 71, 73, 75, 77, 79, 81, 83, 85, 87, 89, 91 and 93. These openings align with the openings in the upper housing. Thus, the plate may be attached by bolts to the existing upper housing.

Also located in the adapter plate 60 is a second set of openings, such as openings 100, 102, 104, 106, 108, 110, 112, 114, 116, 118, 120, 122, 124 and 126. This second set of openings align with the openings in the flange 39, FIG. 3. The adapter plate is attached to the upper housing by placing threaded bolts through the first set of openings in the plate 60 and then threading them into the upper housing. The lower housing may then have threaded bolts, such as the bolt 166, extended through the flange to be received by the second set of openings in the adapter plate. This simple but elegant arrangement solves the problem of attaching a new lower housing to the existing upper housing without modifying in any way the existing upper housing. The adapter plate also acts as a seal to protect the lens system and its associated electronics.

Another advantage of the new housing is the inclusion of a simple mechanism for aligning the new lower housing with the upper housing in a simple manner and without undue expense. The mechanism also accommodates the adapter plate. To achieve this result a pin 130 is mounted to the adapter plate between the recess 61 and the opening 100. This pin is press fitted into the adapter plate and is received by an opening in the upper housing. The pin acts as a pivot for movement of the lower housing relative to the upper housing.

Located between the recesses 68 and 82 is yet another opening 132. Press fitted within this opening is a peg 134, best seen in FIG. 9. The peg has a projection, such as a finger 136, FIGS. 7 and 9, and a recessed slot 138, which can be seen in both FIGS. 6 and 9. As best seen in FIG. 9, the flange 39 of the lower housing 22 includes a threaded opening 142 aligned with the slot 138 in the peg. This allows the insertion of a threaded screw 144 having an off-center projection 146 at its extended end. The off-center projection acts as a cam when the screw is rotated, while the slot 138 acts as a cam follower. With this mechanism and the simple expedient of using a screw driver to rotate the screw 144, a fine adjustment to the alignment relationship between the upper and lower housings may be accomplished.

The use of an off-center projection on a screw is used presently to adjust the existing lower housing to the upper housing. However, the presence of the adapter plate here prevents the off-center projection from aligning the lower housing of the present invention. Therefore, yet another elegant solution is the uniquely designed peg.

Still another advantage achieved by the present invention is that the new lower housing provides for improved ease of operation of the sight system. Referring back to FIG. 2, when the gunner is seated in front of the gun sight system and he is facing in a direction shown by the phantom arrow 150. Hence, the gunner would have the view of the lower housing which is generally the same as the view shown in FIG. 3, but with his or her eye level at about the level of the front wall 30.

Mounted to the front wall 30 are three buttons 152, 154 and 156 consistent with each of the three magnification levels of the new field-of-view lens system. To the left of the three buttons and also mounted to the front wall is a rotatable knob 160 for focusing the lens system. To facilitate manipulation, the front wall has two parts 162 and 164 at an angle to each other. The buttons are located on part 162 and the knob is located on part 164. Finally, beneath the front wall is the rotatable wheel 56 mounted to rotate about a vertical axis. The wheel 56 allows filters to be moved into and out of the optical axis or path.

The location of the wheel allows the gunner to move it with the manipulation of his or her thumb. Adjusting the focus knob 160 is also easily accomplished with the thumb and forefinger. The buttons are easily depressed with one of the fingers. It is to be emphasized again that the present invention is part of the sight system for the main gun of a tank, and thus, it will be operated under highly stressful battlefield conditions. It is the intent here to have the buttons, knob and wheel so situated as to be operated easily and naturally. This is done without interfering with the required concentration that the gunner must devote to enemy targets.

The method for mounting the gun sight system includes the steps of providing the lower housing 22, providing the upper housing 20, and providing the adapter plate 60. The adapter plate has two sets of openings, one set which may be aligned with the openings in the upper housing and the second set which is aligned with openings in the lower housing. The adapter plate is first attached to the upper housing using a plurality of bolts. Another plurality of bolts are used to attach the lower housing to the adapter plate. When the lower housing is being attached, the peg 134 and the screw 144 are used for alignment.

To operate the new sight system the gunner looks through an eye piece (not shown) and presses the desired magnification button; he may then use the knob 160 to focus the lens and the wheel 56 to place a desired filter in the optical axis.

If there is a need to replace or service the sight system, the bolts, such as bolt 166, attaching the lower housing to the adapter plate are loosened and the lower housing with the lens system and the associated electronics are lowered and then moved out of the interior of the tank. Because the new lower housing has integral foot pads the whole unit may be placed directly on a work bench or even on the ground without the need for a mounting jig.

To return the system to the tank requires only the insertion of the system into the upper housing and tightening the bolts.

A three field of view thermal imaging system 200 provides for increased accuracy over conventional thermal imaging systems without requiring manual focusing as one switches from one magnification (field of view) to another. As mentioned above, typically the magnification of such a military imaging system is between 3 and 10. The present invention utilizes a telescope with a fixed medium field of view and a circuit which compensates for changes in the field of view, the temperature and/or the range to assure that the highest resolution picture image available is provided.

Figure 10:
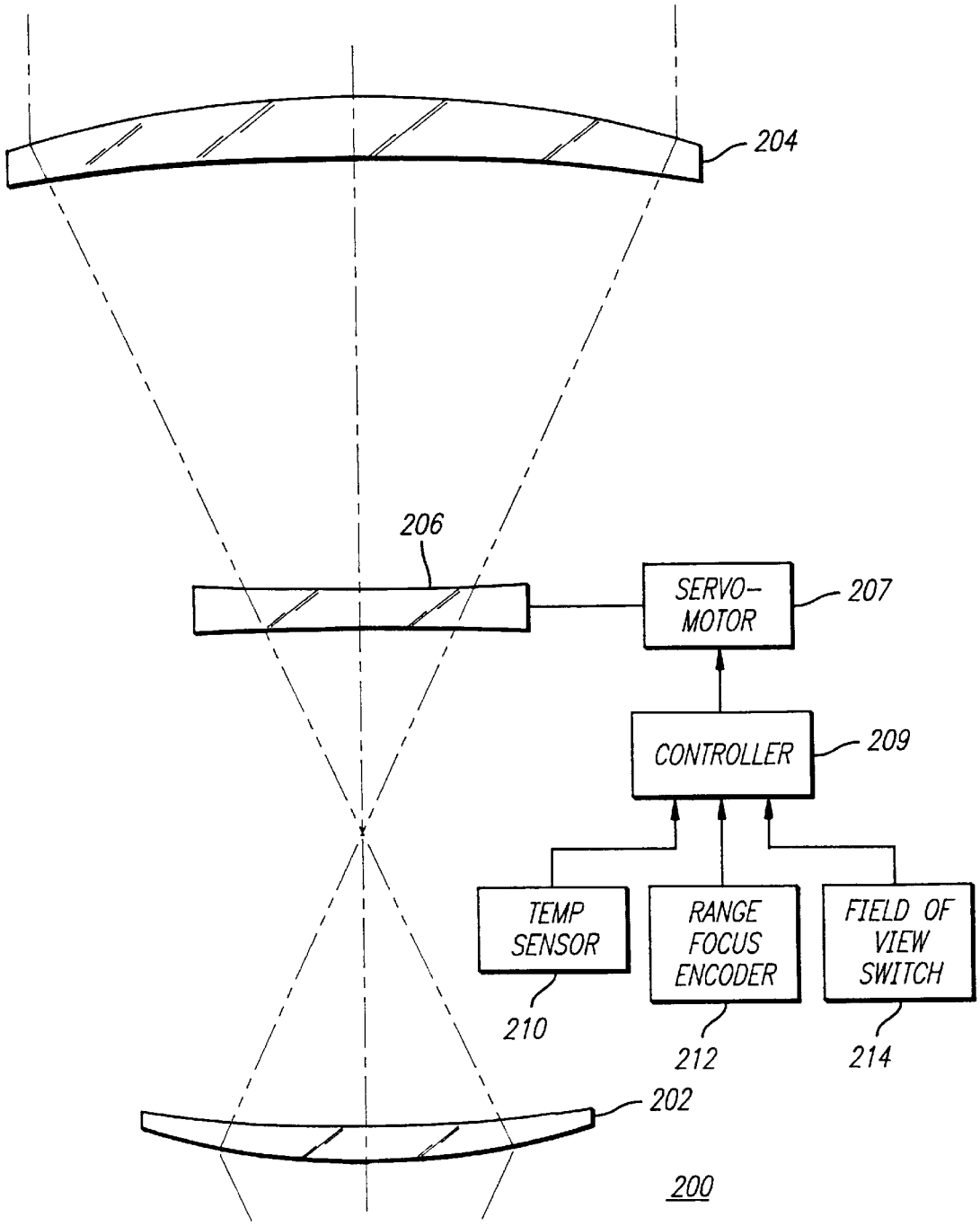
FIG. 10 is a diagrammatic depiction of a thermal imaging system in accordance with the present invention.

To more particularly describe the operation of such a system, please refer to the following description in conjunction with FIG. 10. The thermal imaging system includes a three field of view telescope such as the one disclosed in U.S. patent application Ser. No. 08/363,846, entitled "Three Field of View Refractive IR Telescope with Fixed Medium Field of View," filed Dec. 27, 1994, which has a fixed medium field of view (MFOV). The thermal imaging system 200 can also include a refractive lens cradle for isolating the telescope's refractive lenses from vibration and shock. A typical refractive lens cradle which can be utilized with the system 200 is disclosed in U.S. patent application Ser. No. 08/395,408, entitled "Refractive Lens Cradle," filed Feb. 27, 1995. All of the above-identified patent applications are incorporated by reference herein.

Referring now to FIG. 10, as is seen, the thermal imaging system 200 further comprises an eyepiece lens 202 and an objective lens 204 for providing the images thereto. There are oftentimes other intermediate lenses in between these two lenses to further provide clarity. In addition, there is a focusing lens, the compensator lens 206 in accordance with the present invention which is adjusted by a conventional servo motor 207 under control of a controller 209 to provide for improved clarity. The controller 209 receives inputs from a temperature sensor 210, a range and focus encoder 212 and a field of view switch 214. The controller 209 can be a hard wired device or a microprocessor which is utilized to provide the algorithm for appropriate movement of the compensator lens. For example, controller 209 can be implemented in a variety of manners including hardware systems (combinational logic or lookup tables) or software. The servo motor 207 can be any physical device which is capable of executing the algorithm.

The compensator 206 position as a function of temperature is provided via the temperature sensor 210. Thereafter, the compensator position as a function of range is provided via a range encoder 212. Finally the compensation position as a function of field of view is provided via field of view switch 214. As a result, a three field of view thermal imaging system 200 is provided that has increased accuracy over conventional two field of view systems.

The following will describe the overall operation and the particular equations that will be utilized by the controller 209 to provide for accurate detection and observation of an object. The actual position controls generated by the controller for a typical tank are shown below:

| Focus Algorithm Parameters: Optical zero (inches) 0.2246 Setup temperature (C.) 20 | | | |
|---|---|---|---|
| | WFOV | MFOV | NFOV |
| Slope of temperature curve (m) | 9.1021E−04 | 1.7792E−03 | 1.5236E−03 |
| Intercept of temperature curve (b) | −5.3117E−04 | −1.8122E−03 | −1.2650E−03 |
| Range coefficient (B) | −9.9960E−02 | −1.5232E+00 | −1.523E+00 |
| Range exponent(a) | −9.2383E−01 | −9.9545E−01 | −9.9545E−01 |

where:

m=slope of the temperature curve, b=intercept of the temperature curve,

B=range coefficient, a=range exponent,

T=temperature, the position feedback circuit scale factor (Vin.)=7.984,

WFOV=wide field of view,

MFOV=medium field of view, and

NFOV=narrow field of view.

One of ordinary skill in the art will readily recognize that these parameters are specifically for a particular tank. Other parameters could be used within the spirit and scope of the present invention. From these particular parameters a variety of information can be determined that will allow for the thermal imaging system to operate efficiently.

Focus Algorithm

A general form of the compensator 206 position equation is:

$$\text{Position}(R, \Delta T)=B\times R^{a}+m\times\Delta T+b+\text{optical zero} \quad [1]$$

This equation is applied for each field of view. As is shown in Focus Algorithm parameters shown above, 'B' and 'a' are the same for medium field of view (MFOV) and the narrow field of view (NFOV). Values for 'm' and 'b' are unique for each FOV. In a preferred embodiment, the feedback amplifier, located on the FOV/Focus board converts compensator position to a voltage via a position feedback potentiometer located inside the focus actuator.

Temperature Algorithm $$\text{Position}(T)=m\times\Delta T+b \quad [2]$$

Range Algorithm $$\text{Position}\ (R)=B\times R^{a} \quad [3]$$

The predicted values for the range are those generated by the range equation derived above. Position is the desired position of the compensator based on analysis.

Accordingly, a thermal imaging system is provided that allows for accurate detection and observation of an object. By providing for a compensator lens which is movable by a servo motor based upon conditions such as temperature range and switching between narrow range and medium and wide field of views (FOVs) the distance and resolution of the thermal imaging system is greatly enhanced.

The present invention has been described herein with reference to a particular embodiment for a particular application. Those having ordinary skill in the art and access to the present teachings will recognize additional modifications, applications and embodiments within the scope thereof.

It is therefor intended by the appended claims to cover any and all such applications, modifications and embodiments.

Accordingly,

What is claimed is:

1. An optical gun sight system comprising:

a lens system;

a thermal imaging system including associated electronics;

a lower housing having a length and height for supporting the lens system and associated electronics in an enclosure;

a flange disposed on said lower housing adapted to be used to fasten the lower housing to a pre-existing internal upper housing for fully enclosing the lens system and associated electronics; and an adapter seal plate having means for connecting to the upper housing and means for connecting to said flange.

2. The invention of claim 1 wherein:

the lens system is a three field of view telescope.

3. The invention of claim 2 wherein said telescope includes:

a first lens for receiving an image of object;

a second lens in optical communication with the first lens for viewing the image of a object; and means in optical communication with said first and second lens for compensating for magnification, field-of-view and/or temperature related changes in the optical performance thereof.

4. The invention of claim 3 wherein:

said means for compensating includes a third lens.

5. The invention of claim 4 wherein:

the third lens is a compensator lens.

6. The invention of claim 4 wherein:

said means for compensating includes means for moving said third lens.

7. The invention of claim 6 wherein:

said means for moving said lens includes a lens position actuator and a controller for same.

8. The invention of claim 7 further including:

a sensor for receiving temperature information and providing a voltage representative of the temperature information to the controller.

9. The invention of claim 7 further including:

range encoder means for providing information regarding the distance of the object to the controller.

10. The invention of claim 7 further including:

a switch means coupled to the controller for switching the thermal imaging system between a plurality of fields of view.

11. The invention of claim 1 comprising:

a three field of view telescope including a wide field of view, a narrow field of view, and a fixed medium field of view;

a compensator lens movably located within the three field of view telescope for providing an accurate thermal image of the object; and a control means for controlling the position of the compensator lens, the control means further comprising:

a servo motor coupled to the compensator lens for moving the compensator lens, a microcontroller for controlling the servo motor, a sensor for receiving temperature information for and providing a voltage representative of the temperature information to the microcontroller, a range encoder for providing information regarding the distance of the object to the microcontroller, and a switch means coupled to the microcontroller for switching the three field of view telescope between the wide field of view narrow field of view and fixed medium field of view.

12. The invention of claim 1 wherein said lower housing includes four wall portions and a bottom portion having a plurality of downwardly extending projections for supporting the four wall portions and said flange, and for supporting the lens system and associated electronics when mounted in said lower housing.

13. The invention as claimed in claim 12 wherein:

said plurality of projections comprise three arcuate shaped feet, each disposed at one of three corners of said bottom portion, said feet having their concave surfaces facing inwardly toward the center of said bottom portion; and a fourth projection disposed near the fourth corner of said bottom portion and comprising an arcuate shaped foot positioned generally parallel to one of said three first mentioned feet.

* * * * *